US005218911A

United States Patent [19]

Rehbein et al.

[11] Patent Number: 5,218,911

[45] Date of Patent: Jun. 15, 1993

[54] SPLIT SKID PROTECTION CASTING AND INSERT ADAPTER FOR REPLACEMENT OUTLET VALVE OF A TANK CAR

[75] Inventors: Richard E. Rehbein, Valparaiso, Ind.; Michael D. Gaikowski, Homewood, Ill.

[73] Assignee: General Electric Railcar Leasing Services Corporation, Chicago, Ill.

[21] Appl. No.: 745,156

[22] Filed: Aug. 15, 1991

[51] Int. Cl.[5] ..... B61D 5/00

[52] U.S. Cl. ..... 105/358; 137/350; 251/144

[58] Field of Search ..... 105/358, 362, 360; 137/347, 348, 377, 382, 350; 251/144, 359, 360; 220/85 P

[56] References Cited

U.S. PATENT DOCUMENTS

| | | | |
|---|---|---|---|
| 4,184,663 | 1/1980 | Rollins et al. | 251/144 |
| 4,220,097 | 9/1980 | Wempe et al. | 105/360 |
| 4,234,158 | 11/1980 | Rollins et al. | 137/350 |
| 4,269,220 | 5/1981 | Rehbein | 251/144 |
| 4,394,002 | 7/1983 | Polley | 251/144 |
| 4,461,397 | 7/1984 | Portis | 251/144 |
| 4,527,489 | 7/1985 | Schlink | 105/358 |
| 4,690,164 | 9/1987 | Gardner et al. | 251/144 |
| 4,697,528 | 10/1987 | Rehbein | 105/358 |
| 4,892,042 | 1/1990 | Dalrymple et al. | 105/362 |

*Primary Examiner*—Mark T. Le

*Attorney, Agent, or Firm*—Myers & Associates, Ltd.

[57] ABSTRACT

A skid protective casting and adapter for a tank car for retrofitting a new outlet bottom valve on a tank car. The skid protective casting includes two separate sections having sloped bottom surfaces. The skid protective casting is welded in a manner that post weld heat treatement is not required in connection with the retrofitting procedures. The new outlet valve is affixed to the existing valve saddle with an adapter plate for economical and effective mounting.

18 Claims, 4 Drawing Sheets

SPLIT SKID PROTECTION CASTING AND INSERT ADAPTER FOR REPLACEMENT OUTLET VALVE OF A TANK CAR

BACKGROUND OF THE INVENTION

1. Field of the Invention

This invention relates to railway tank cars and more specifically, to a split skid protection casting and insert adapter for replacement outlet valve of a tank car.

2. Summary of the Prior Art

Railway tank cars are commonly utilized for transporting bulk freight in liquid or semi-liquid form. A large number of the commodities transported by tank cars fall within the government classification of hazardous materials. The commodity carried in the tank car is discharged through an outlet extension nozzle that is connected to the outlet valve mounted at the bottom of the tank.

The bottom outlet valve and outlet extension nozzle create discontinuities or protuberances at the bottom of the tank car. The presence of such a discontinuity, if not protected, raises the risk that the protruding structure, particularly the bottom outlet valve, will rupture in a disrailment situation by impacting against the rail or other surface. As a result of this potential hazard, the Association of American Railroads (A.A.R.) has specified that the bottom fittings for discharge be equipped with a bottom protection device, commonly referred to as skids, that prevent undesired discharge of the commodities upon derailment. An example of a prior protection device in the form of a skid is disclosed in U.S. Pat. No. 4,697,528 issued Oct. 6, 1987 to R. E. Rehbein.

In recent years it has become advantageous to replace existing bottom outlet valves of tank cars in service with newer more efficient bottom outlet valves. For example, relatively older tank cars are equipped with a bottom outlet valve manufactured by ACF Industries, Inc., known as an ACF Low Profile 6" Bottom Operated Outlet Valve. It is advantageous to retrofit such existing outlet valves with more efficient bottom outlet valves, such as, for example, a Jamesbury Low Profile Bottom Outlet Valve (4" AZFRC, Mod. B).

Several problems are associated with prior techniques of retrofitting a bottom outlet valve to a tank car that make known replacement methods a relatively difficult and expensive task. Current procedures for retrofitting bottom outlet valves on tank cars require an opening be made in the tank shell with the result that stress relieving (post weld heat treatment) and internal bracing must be done, which is a time consuming and costly procedure. When stress relieving a car, moreover, it disadvantageously elevates the temperature of the tank car shell, thus causing damage to paint and interior lining. Accordingly, it is desirable to provide improved devices and methods by which a more efficient bottom outlet valve is retrofitted on an existing tank car without the requirement of stress relief of the tank shell and the problems associated therewith.

SUMMARY OF THE INVENTION

This invention relates generally to a split skid protection casting and insert adapter for a replacement outlet valve for a railway tank car. The skid casting and adapter of the invention permit the installation of a more efficient low profile bottom outlet valve in place of the valve as originally manufactured. The installation of a new valve mechanism in a tank car in service results in numerous advantages, including a lower profile and an increase of the overall efficiency of discharge while eliminating the inherent disadvantages of existing bottom outlet valves that require nearly ten full turns to close a valve and that have an overall poor handle design for discharge and closing. The technique of mounting a new bottom discharge valve in accordance with the invention is attained without the requirement of making an opening in the tank shell that requires elaborate stress relief procedures as previously described. The retrofitted bottom discharge valve of the invention can be affixed to a tank car having a flat bottom center course or a sloped tank to bottom centerline design. Moreover, the newly installed outlet valve is protected by a skid protection casting having separate cast portions that are each welded to the existing mounting saddle and with a minimum of welds directly to the tank shell. The skid casting of the invention is attached to the tank shell by a weld configuration so that stress relief is not required in accordance with A.A.R. standards that require stress relief procedure be made where weld sizes and lengths exceed certain prescribed standards. The skid casting of the invention permits flexing of the tank without interference, while maintaining effective protection of the outlet discharge valve during impact conditions. Accordingly, a more effective and efficient bottom outlet valve can be retrofitted in place of existing bottom discharge valves of tank cars without elaborate modifications of the tank shell, such as requiring the disadvantages associated with making openings in the shell, elevating the temperature of the shell for stress relieving and the necessary bracing due to these operations.

DESCRIPTION OF THE PREFERRED EMBODIMENT

Figure 1:
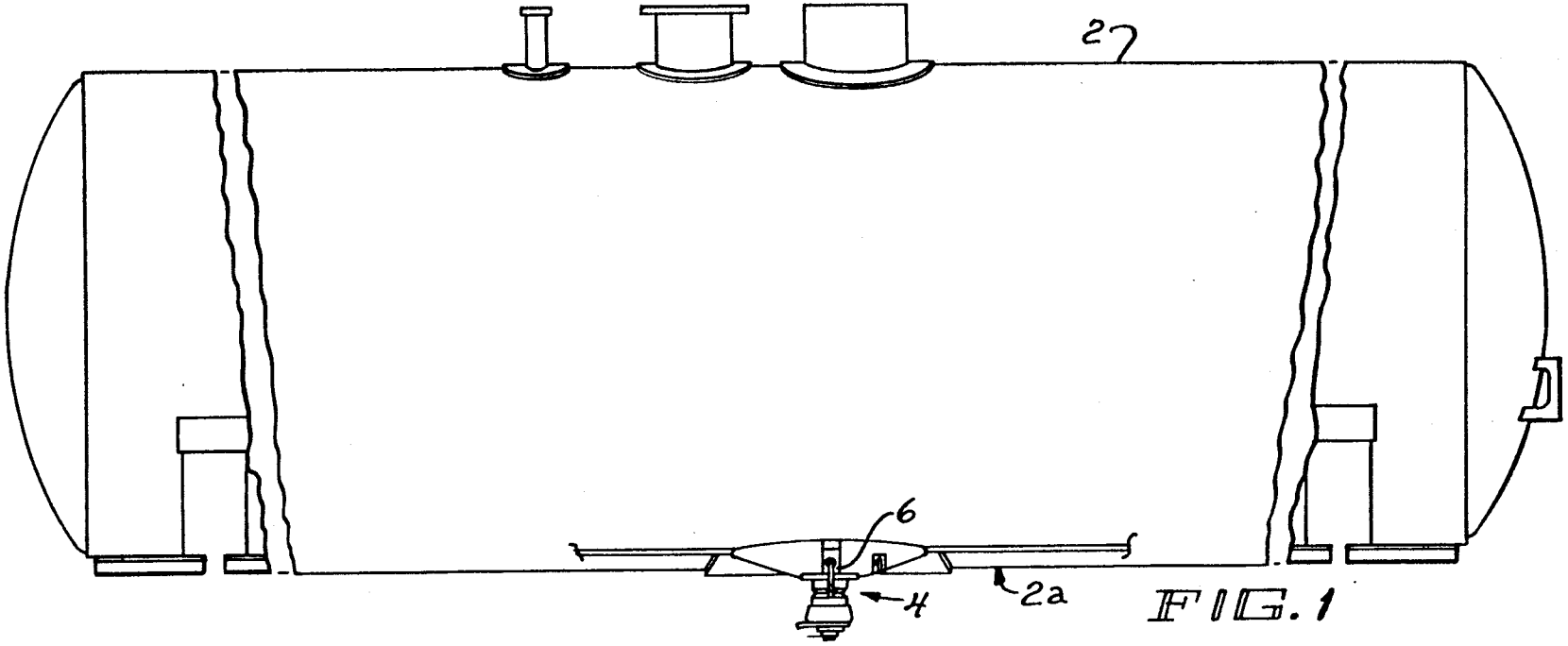
FIG. 1 is a side elevational view, with parts cut away, of a tank shell of a tank car having the split skid protection casting and insert adapter for a replacement outlet valve of the invention mounted thereon.
Figure 2:
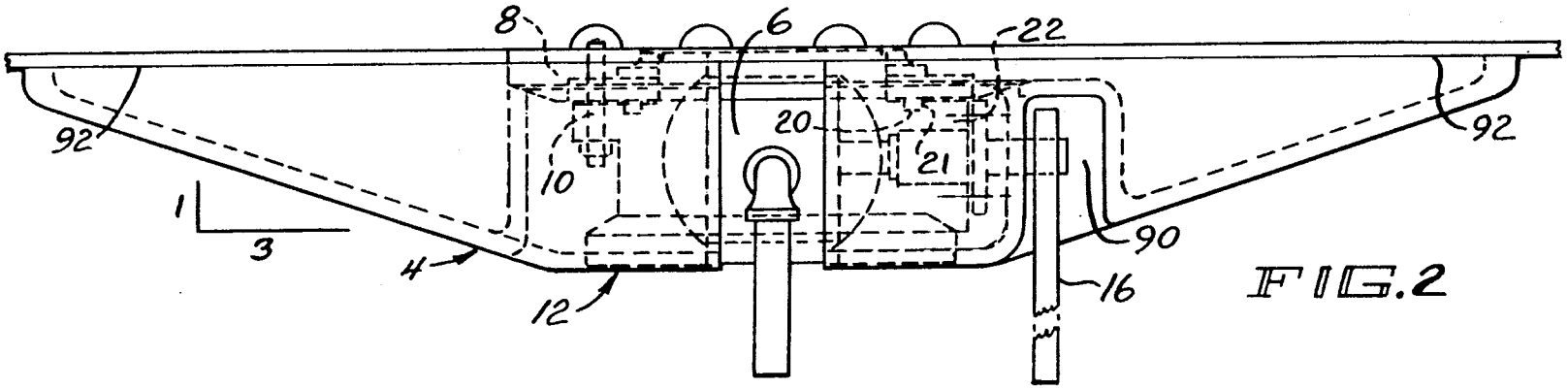
FIG. 2 is a side elevational view of the split skid protection casting and insert adapter that is bolted in above the replacement bottom outlet valve.
Figure 3:
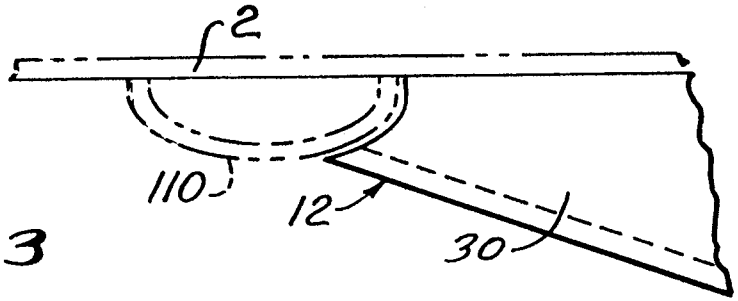
FIG. 3 is a partial detail, showing the modification of the skid protection casting of the invention for use in particular situations.
Figure 4:
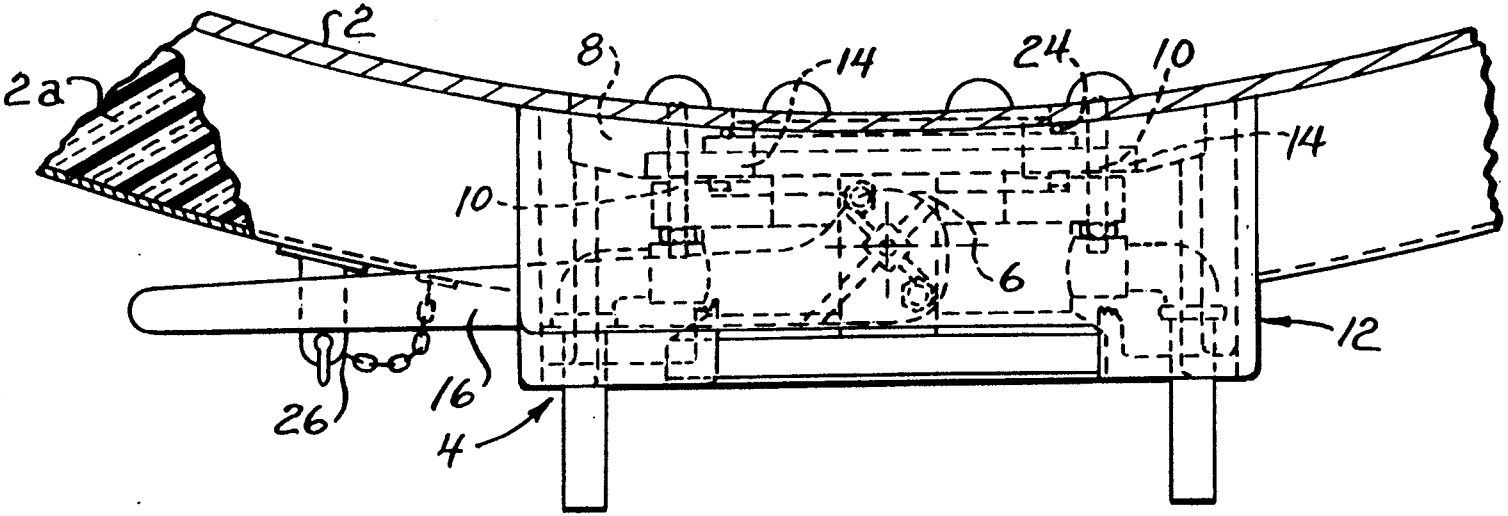
FIG. 4 is an end elevational view, showing the split skid protection casting enclosing the insert adapter and replacement outlet valve of FIG. 1.

Referring now to FIGS. 1, 2 and 3, there is illustrated a conventional tank shell 2 of a railway tank car on which the split skid protection casting and insert adapter for a replacement outlet valve of the invention, generally designated by reference numeral 4, has been mounted. The skid casting and adapter 4 are utilized in connection with a new bottom outlet valve 6 that has been retrofitted to replace the existing, less efficient bottom outlet valves as originally equipped. As a preliminary step in installing the skid casting and adapter 4 and the new valve 6 on tank shell 2, the existing bottom outlet valve (not shown), such as a commercially known ACF Low Profile Bottom Operated Valve, is removed from the bottom of the tank shell 2. A portion of the insulation jacket 2*a* (FIG. 4) of the tank shell 2 is cut away over a suitable area, such as, for example, with an opening of 46"×19" centered around the mounting saddle 8, to which the existing valve (not shown) was affixed. In FIGS. 2 and 4 the existing mounting saddle 8 for the bottom outlet valve being replaced, is shown and is known as the ACF mounting saddle. In order to permit the attachment of the skid casting adapter 4, a plurality of new stud bolts 10 are installed into the existing ACF mounting saddle 8, such as eight stud bolts 10 as shown.

The skid protective casting 12 of the invention is then affixed to the existing mounting saddle 8, with a majority of welds being applied directly to the mounting saddle 8 and a minimal amount of weld being applied to the tank shell 2 to alleviate the necessity of post heat treatment as will be described. A new valve 6, such as a Neles-Jamesbury Low Profile Bottom Outlet Valve (4" AZFRC, Mod. B), having eight equally spaced mounting holes around its flange is mounted to an insert plate 14. The bottom outlet valve 6 is fitted with a valve handle 16 that moves from a horizontal orientation in its closed position to a vertical orientation in the open position. The insert plate 14 bears against a gasket seal 20 inserted in the top groove 21 of the AZFRC valve flange 22. The stud bolts 10 extend downward from the saddle 8 through the insert plate 14 and through the AZFRC valve flange 22 when the components are mounted. An O'ring 24 is further installed between the mounting saddle 8 and the insert plate 14. A handle locking device and pin arrangement 26 is also provided to lock the handle.

Upon completion of the mounting of the AZFRC Mod. B, valve 6, it is necessary to restore any removed insulation on all insulated cars and apply new jacket flashing to the outlet areas. The foregoing retrofitting procedures are accomplished without elevating the temperature of the tank shell and without requiring stress relief or internal bracing. Further, by filling the tank with water during the retrofit procedures as disclosed herein, any lining on the tank shell interior is protected. It should be noted that the new bottom outlet valve 6 creates a protrusion that must be protected down to its bottom most discontinuity in accordance existing D.O.T. and A.A.R. regulations. This line is called the "horizontal shear plane".

Figure 5:
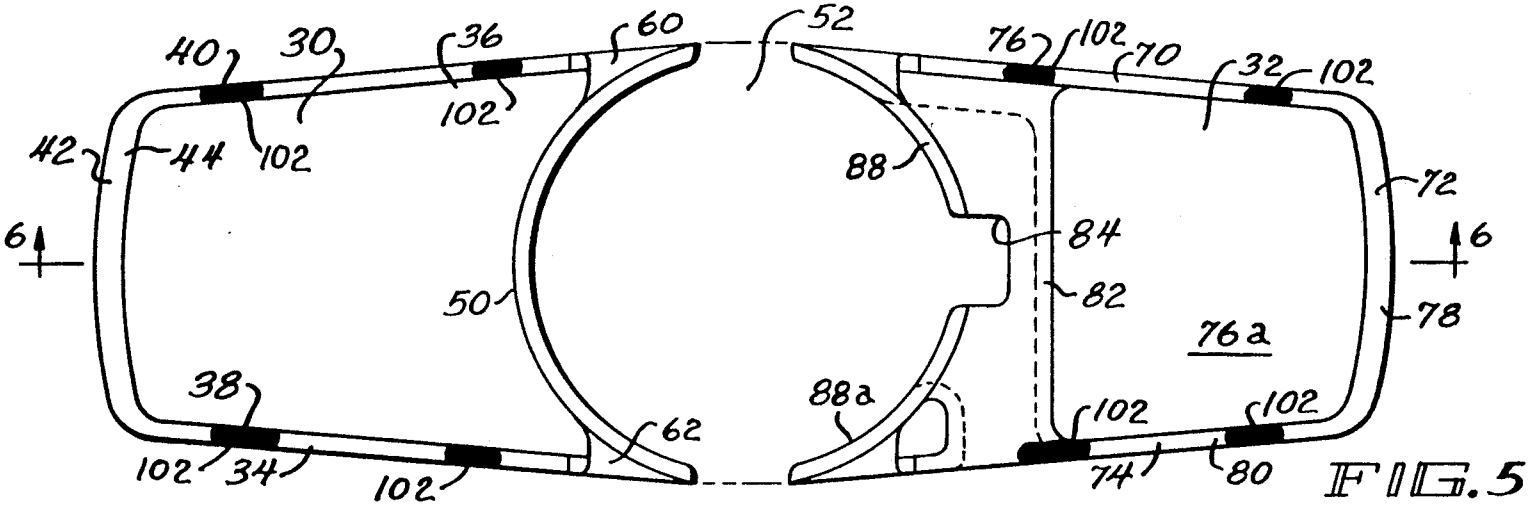
FIG. 5 is a top plan view of the skid protective casting of FIG. 1.
Figure 6:
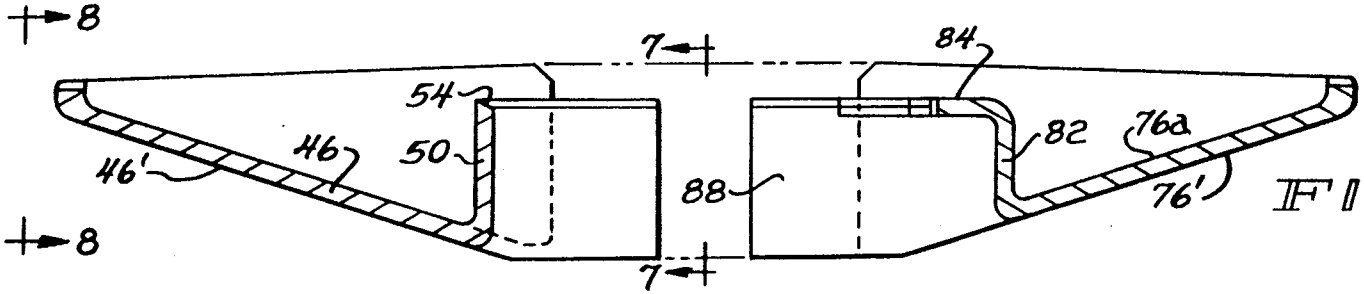
FIG. 6 is a side elevational view, with parts in section, taken along lines 6—6 of FIG. 5.
Figure 8:
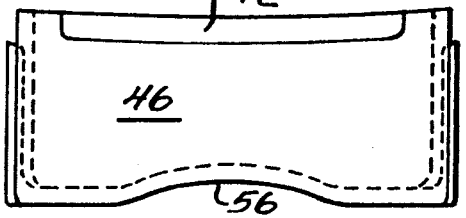
FIG. 8 is an end elevational view taken along lines 8—8 of FIG. 6.
Figure 7:
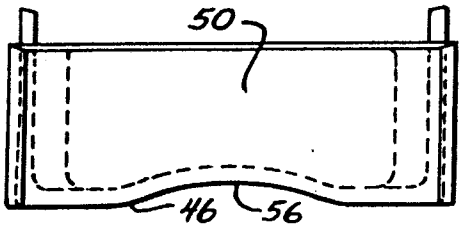
FIG. 7 is an end elevational view taken along lines 7—7 of FIG. 6.
Figure 9:
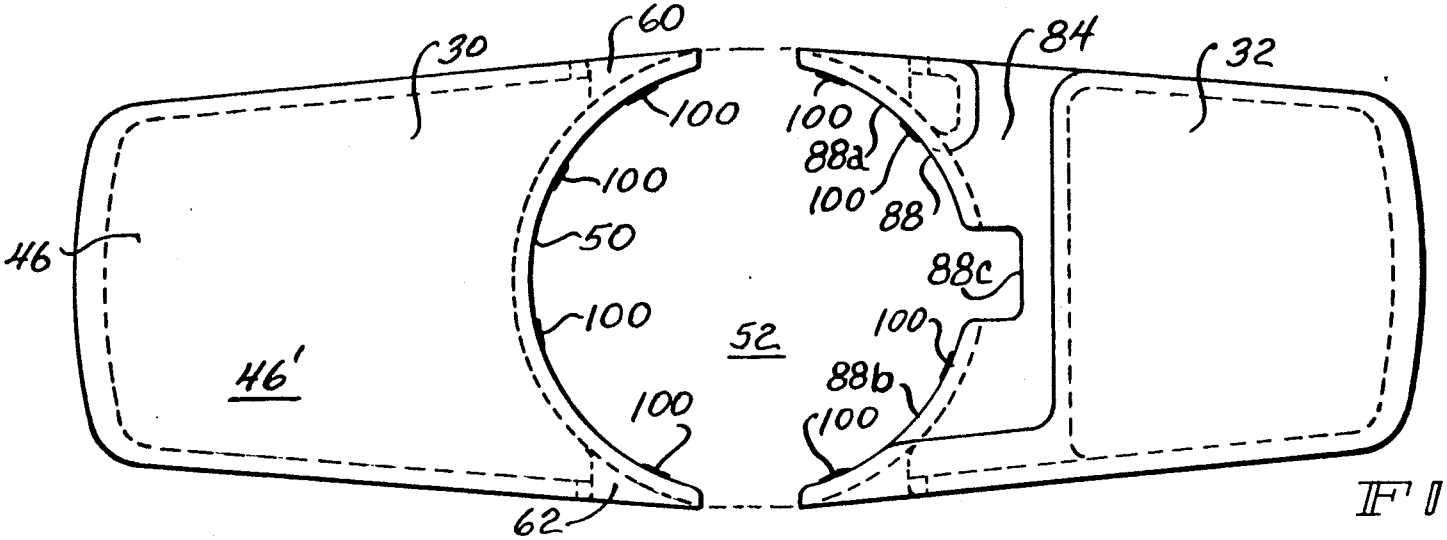
FIG. 9 is a bottom plan view of the split skid protection casting of the invention.
Figure 10:
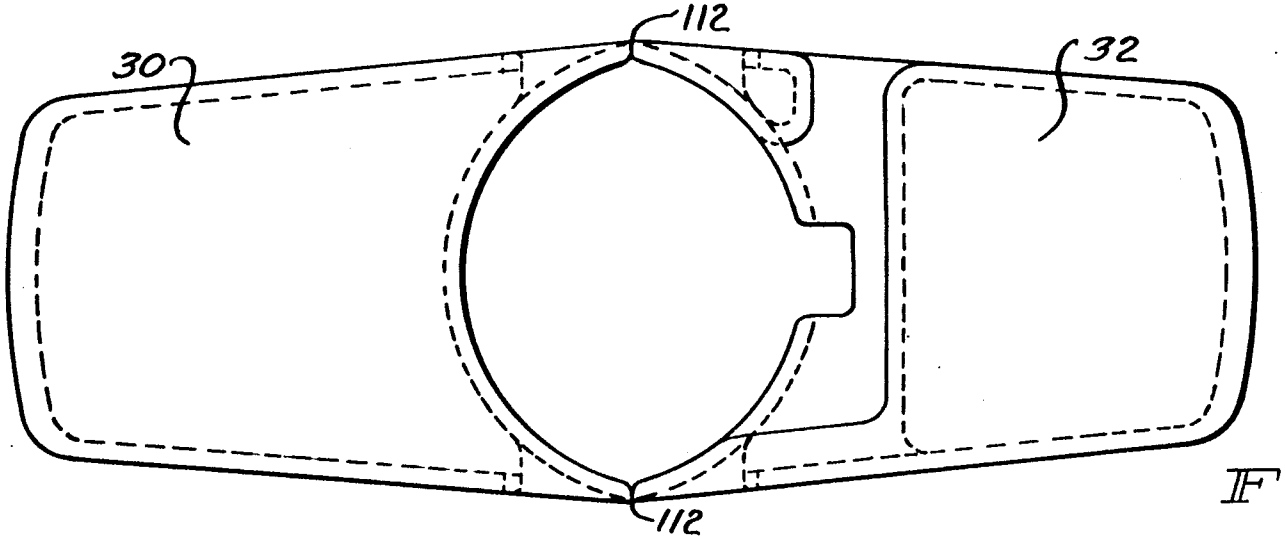
FIG. 10 is a bottom plan view of the split skid protective casting of the invention after being cast and before being severed to form its split configuration.

Referring now to FIGS. 5 to 10, details of the configuration of the skid protective casting 12 of the invention to protect the protrusion are illustrated. The skid protective casting 12 is formed into two split cast sections 30 and 32 as seen in FIGS. 5 and 6. The split sections 30 and 32 taper inward toward the ends of the skid in the plan view (FIG. 5). The skid casting section 30 is formed with a pair of spaced upright longitudinal walls 34, 36 which provide upper edge portions 38 and 40. A slightly curved end wall 42 is integrally formed with the walls 34 and 36 and provides an upper edge 44. The bottom of the section 30 is provided with a sloped base 46 integrally formed between the sidewalls 34, 36 and with end wall 42. The base 46 forms a sliding surface having, for example, a 1 to 3 ratio slope to deflect impacts or derailment of the tank car. The sloped base 46 terminates inwardly with a upright, partial shell section 50 which extends for an arc of less than 180 degrees and defines an opening 52 of a generally circular cross sectional configuration in connection with the opposed section 32 of the skid protection casting as seen in FIG. 5. The upper portion of the curved upright section 50 is formed with an upper slanted edge 54 as best seen in FIGS. 5 and 6. With reference to FIG. 6, the upper edges 34 and 36 are sloped downward from the opening 52 in an outer direction. In addition as seen in FIGS. 7 and 8, the sloped base 46 includes a concave configuration 56. As seen in FIGS. 5 and 8, the sidewalls 34 and 36 terminate inwardly in connection with connecting portions 60, 62 which are in turn formed with the curved wall 50.

The opposite section 32 of the skid protection casting 12 of the invention is somewhat modified in comparison to section 30. The section 32 includes a sidewall 70, an end wall 72 and a opposite sidewall 74 forming respective upper edges 76, 78 and 80. The base 76*a* of section 32 slopes downward in an inward direction to form deflecting surface 76' and terminates with an upright, generally flat wall 82 that is connected to generally horizontal portion 84. The horizontal portion 84 extends laterally between wall 74 and the other side of the section 32. A split circular wall 88 having split sections 88*a*, *b* and forming an opening 88*c* extends from horizontal portion 84. As best seen in FIGS. 2 and 6, the wall 82, horizontal portion 84, and circular wall 88 form a passage 90 in connection with opening 88*c* by which the valve handle 16 is attached to bottom outlet valve 6 and may be either horizontally (closed) or vertically (opened) disposed when said skid protective casting 12 is in position.

The improved design of the skid protective casting 12 of the invention permits weld attachment to the tank shell without exceeding 3" in length for any intermediate welding for a total lineal welding of less than 24" per bracket as provided in the manual of Recommended Practices of the Association of American Railroads (A.A.R.) Specifications for Tank Cars. Post weld heat treatment is required when such weld specifications are exceeded, but in view of the unique mounting of the invention such post weld heat treatment is not necessary. Each of the circular surfaces defining the hole 52 are affixed to the saddle by eight welds 100 at four different locations, none of which exceed 3" in length. In addition, eight welds 102 are applied to affix the sidewalls to the tank shell 92 and likewise do not exceed 3" for any intermediate length. Because the skid protection casting 12 of the invention comprises two separate sections, the total length of the weld applied to sections 100 and 102 also does not exceed the 24 inches as prescribed by A.A.R. Specifications so as to avoid the necessity of post weld heat treatment. The skid protection casting 12 is capable of being fitted on flat or sloped bottom tank cars and its split design allows for necessary steam connections, when applicable. The casting also permits flexing of the tank shell 2 and is highly effective in protecting a valve during impact conditions that may occur. As seen in FIG. 3, one end of the skid protective casting 12 is trimmed off or coped out when necessary to clear an interfering exterior header coil 110. As further shown in FIG. 10 the skid protective casting 12 can effectively be manufactured by being cast as a single body having a pair of grooves 112 that can be used as guides to saw the two sections 30 and 32 in half after casting.

What is claimed is:

1. A tank car including a tank body having an outer surface and a valve protrusion extending downwardly from said outer surface comprising protective means being affixed to the tank body for protecting the valve protrusion against impacts or derailment, said protective means having a pair of split sections each being affixed to the tank body, said split sections having confronting ends forming an opening disposed in surrounding relationship to the valve protrusion, each of said split sections having a sloped bottom acting as deflection surfaces in event of impacts or car derailment, a plurality of welds for affixing said split sections separately to said tank body, a saddle affixed to said outer surface, said split sections each being welded to said saddle, and means for affixing the valve protrusion to said saddle; and wherein said split sections are attached to said saddle by welds applied along upper edges of said split sections.

2. The tank car according to claim 1 wherein said opening is defined by partial vertical shell portions formed on said confronting ends of said split sections.

3. The tank car according to claim 2 wherein said partial shell portions have a sliding concave bottom edge section.

4. The tank car according to claim 2 wherein one of said partial vertical shell portions includes an opening for receiving a handle element.

5. The tank car according to claim 4 wherein one of said split sections includes a passageway in communication with said handle opening, said passageway permitting movement of a handle connected to said valve protrusion between a vertical and horizontal orientation.

6. The tank car according to claim 5 wherein said passageway is defined by a vertical wall and at least a portion of one of said partial shell portions.

7. The tank car according to claim 1 wherein said valve protrusion is a bottom outlet valve.

8. The tank car according to claim 1 further comprising an adapter plate imposed between said saddle and said valve protrusion.

9. The tank car according to claim 1 wherein said split sections are affixed to said saddle and the car body by a plurality of welds applied in separate sections, each of said sections extending for less than three inches.

10. The tank car according to claim 9 wherein said plurality of welds extend for less than twenty-four inches on each of said sections.

11. A tank car including a tank body having an outer surface and a valve protrusion extending downwardly from said outer surface, comprising protective means being affixed to the tank body for protecting the valve protrusion against impacts or derailment, said protective means having a pair of split sections each being affixed to the tank body, said split sections having confronting ends forming an opening disposed in surrounding relationship to the valve protrusion, each of said split sections having a sloped bottom acting as deflection surfaces in event of impacts or car derailment, said valve protrusion is a bottom outlet valve, a saddle member being affixed to said outer surface, said bottom outlet valve being mounted on said saddle member and said pair of split sections include upper edges, and a plurality of welds being applied adjacent said upper edges and on said saddle for affixing said split sections to said saddle.

12. The car according to claim 11 where said plurality of welds being applied in sections, said sections each extending for less than three inches in extent.

13. A method of retrofitting an existing bottom outlet valve mounted on a tank shell of a tank rail car with a replacement outlet valve comprising the steps of removing the existing bottom outlet valve from the tank shell, applying attachment means to an existing saddle of the tank car, attaching at least a portion of a skid protective member to said saddle, and directly attaching at least an upper edge portion of said skid protective member to said saddle, wherein said upper edge portion is defined with said skid protective member oriented in a mounting position at the bottom of the tank rail car.

14. The method according to claim 13 further comprising the step of attaching a second skid protective member to said saddle.

15. The method according to claim 14 wherein said step of attaching said protective members includes the step of applying a first plurality of welds between each of said members and said saddle.

16. The method according to claim 15 further including the step of applying a second plurality of welds between each of said members and said tank shell.

17. The method according to claim 16 wherein said first and second plurality of welds are applied in sections having lengths not exceeding three inches.

18. The method according to claim 17 wherein the total of said lengths of said first and second plurality of welds is less than twenty-four inches.

* * * * *